United States Patent [19]

Tsuneki

[11] 4,313,239

[45] Feb. 2, 1982

[54] HINGE MOUNTING PLATE

[75] Inventor: Ken Tsuneki, Tokyo, Japan

[73] Assignee: Sugatsune Industrial Co. Ltd., Tokyo, Japan

[21] Appl. No.: 88,031

[22] Filed: Oct. 25, 1979

[51] Int. Cl.[3] ..... E05D 7/04

[52] U.S. Cl. ..... 16/236; 16/241

[58] Field of Search ..... 16/129, 130, 131, 132, 16/133, 236, 241, 240

[56] References Cited

U.S. PATENT DOCUMENTS 3,863,292 2/1975 Grunert et al. ..... 16/130 X 3,890,670 6/1975 Sewing et al. ..... 16/129

*Primary Examiner*—Peter P. Nerbun

*Attorney, Agent, or Firm*—George B. Oujevolk

[57] ABSTRACT

A hinge mounting plate is used for pivotally securing the supporting arm of a door to a supporting arm for a furniture or the like. This hinge mounting plate incorporates a base plate, a control plate, and a hinge supporting arm. The base plate is secured directly to the supporting wall. The control plate is superimposed on the base plate to be slidable in the direction perpendicular to the longitudinal direction. The hinge supporting arm is formed in an inverted U shape in cross section with a top wall and upper and lower side walls. The hinge mounting plate thus constructed further comprises a longitudinal and lateral control plate superimposed on the surface of the control plate and perforated with a long hole for guiding the control plate, and a lateral control screw pivotally securing both the rear side ends of the longitudinal and lateral control plate and the hinge supporting arm at the front side end of the control plate. Thus, the hinge mounting plate can be adjusted longitudinally, laterally and elevationally in the relative relationship between the supporting wall and the door.

1 Claim, 6 Drawing Figures

HINGE MOUNTING PLATE

BACKGROUND OF THE INVENTION

This invention relates to a hinge and, more particularly, to a hinge mounting plate for the mounting of a door of furniture or the like.

When a door is pivotally mounted by hinges, it is necessary to retain the relationship between a supporting wall such as a door mounting frame or the like and the door, namely between an entrance and the door in a desired state.

If an error occurs at the mounted door or the supporting wall member, it is further necessary to adjust the mounting of the door to accurately retain the adjusted state.

In order to satisfy the aforementioned conditions in the relative relationship between the supporting wall and the door, the conventional hinge mounting plate is longitudinally, laterally and elevationally adjustable by the combination of a plurality of components.

As shown in FIGS. 1 and 2, the known conventional hinge mounting plate consists of a base plate 2 directly mounted on supporting wall 1 and perforated with long slots 3 in the direction perpendicular to the longitudinal direction, and clamped to the wall 1 by wooden screws 4, and a control plate 5 superimposed on the surface of the base plate 2. Lugs 6 and recess grooves 7 are so formed at the control and base plates 5 and 2, in the direction at a right angle with respect to the longitudinal direction so as to engage with each other in an attitude such that the control plate 5 is engaged at desired position. Flush head screws 9 are inserted into long holes 8 formed in the direction perpendicular to the longitudinal direction at the control plate 5 to be fastened into the base plate 2 for clamping it to the base plate 2. A hinge supporting arm 10 is superimposed on the control plate 5 and perforated with a long hole 11 in longitudinal direction for guiding the control plate 5 longitudinally, a clamping screw 12 inserted into the hole 11 to clamp the supporting arm 10 to the control plate 5, and an adjusting screw 13 is fastened to the arm 10 for elevationally controlling the arm 10 with respect to the plate 5 opposite to the surface of the control plate 5.

Such a hinge mounting plate can be longitudinally adjusted with respect to the control plate 5 at the hinge supporting arm 10 in the direction perpendicular to the longitudinal direction at the base plate 2 with respect to the control plate 5 when the screw 9 or 12 is loosened, and is laterally adjusted with respect to the control plate 5 at the hinge supporting arm 10 by adjusting the screw 13 so that the screw 12 is loosened.

The hinge mounting plate can be adjusted in elevation in the direction designated by arrows a—1′ solely by the use of screw 9, but it is necessary to adjust both screws 12 and 13 when adjusting longitudinally or laterally as designated by arrows b—b′ or c—c′ so that the adjusting operation is complicated. In addition, since it is difficult to simultaneously loosen or tighten both the screws 12 and 13, it is necessary to adjust, for example, in one direction while retaining the hinge in the other direction without displacement. However, it can be easily and finely adjusted with the consumption of a long time in the adjustment even though there is difficulty in the accurate adjustment.

SUMMARY OF THE INVENTION

Accordingly, a primary object of this invention is to provide a hinge mounting plate which can be adjusted longitudinally, laterally and elevationally in the relative relationship between the supporting wall such as furniture and a door readily in desired accurate state.

It is another object of this invention to provide a hinge mounting plate which can eliminate the disadvantages of the conventional hinge mounting plate to accurately adjust in the respective directions merely by one screw easily and rapidly.

It is still another object of this invention to provide a hinge mounting plate which can be longitudinally adjusted by loosening the longitudinal control screw without error in the lateral direction by pivotally integrating the hinge supporting arm at the rear side end of the lateral control plate.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
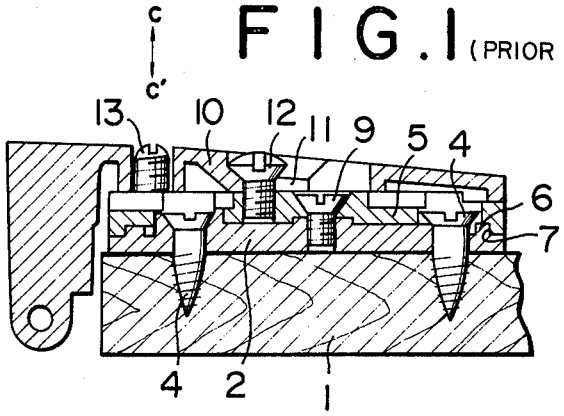
FIG. 1 (PRIOR ART)
FIGS. 1 and 2 are elevational side sectional and plan views of the conventional hinge mounting plate with the control plate and the base plate assembled.
Figure 2:
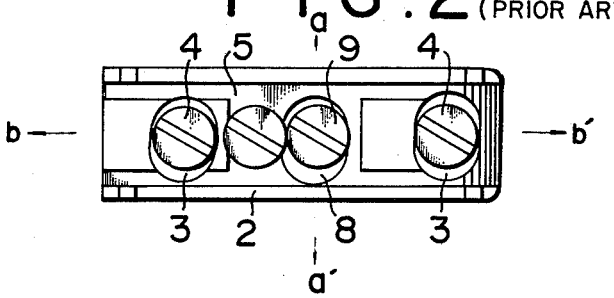
FIG. 2 (PRIOR ART)

Referring now to the drawings, particularly to FIGS. 3 to 6, wherein like reference numerals designate the same parts in the following views, a hinge mounting plate is pivotally secured via supporting arm and pin to a door to be mounted at a supporting wall 21 composed of the side frame of furniture or the like consists of a base plate 22, a first control plate 23, a longitudinal and lateral control plate 24, and a hinge supporting arm 25.

The base plate 22 is secured directly to the supporting wall 21 by inserting wooden screws 27 through holes 26, perforated at both longitudinal ends into the wall 21. Recess grooves 28 are formed at proper interval in parallel in the direction perpendicular to the longitudinal direction thereof on the surface of the base plate 22. A mounting screw 30 is screwed to the threaded hole 29 perforated at the thick portion 31 retained between the recess grooves 28 at the base plate 22.

The first control plate 23 is so superimposed on the base plate 22 as to be slidably in the direction perpendicular to the longitudinal direction thereof with a recess groove 32 formed on the back surface thereof and engaged with a thick portion 31 of the base plate and having an elevational guide hole 33 perforated in the direction which is perpendicular to the longitudinal direction thereof so as to be engaged by the screw 30.

The control plate 23 has a width in the direction perpendicular to the longitudinal direction thereof considerably narrower than that of the base plate 22 with a longitudinal control screw 34 connected at the front side end from the center thereof.

The longitudinal and lateral second control plate 24 is formed at the center thereof with a recess 35 on the back surface so as to act as a longitudinal guide engaged with the control plate 23 which has a long hole 36 passing longitudinally through the recess 35 for receiving the screw 34 for engaging the longitudinal and lateral control plate 24.

The hole 36 thus perforated communicates with a cutout circular hole 37 perforated in larger diameter than that to insert the head of the screw 34 therethrough.

A long hole 38 is also perforated at the front end of the plate 24 longitudinally. The hole 38 communicates with an enlarged lateral hole 38' perforated at the inner end of the long hole 38 to be engaged with the neck of the lateral control screw which will be described in greater detail.

The hinge supporting arm 25 is formed in inverted U shape in cross section with a top wall 39 and upper and lower side walls 40 for internally mounting the longitudinal and lateral second control plate 24 with pin holes 41 perforated at the upper and lower walls 40 at the front side ends to be pivotally secured by the supporting arm and pins mounted on a door (not shown).

The hinge supporting arm 25 is pivotally secured at the rear end by a pin 42 for internally mounting the second control plate 24 which is fastened with a lateral control plate 24 and is screwed with a lateral control screw 44 through a threaded hole 43 at the top wall 39 corresponding to the long hole 38 to engage the neck 44' of the screw 44 with the hole 38 to prevent axial movement of the screw 44.

Figure 4:
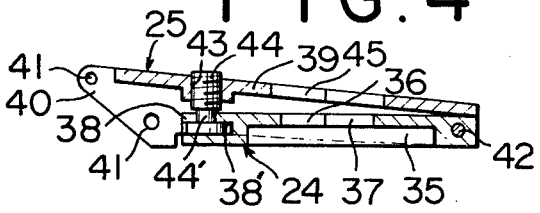
FIG. 4 is an elevational side sectional view of the longitudinal and lateral control plates assembled with the hinge supporting arm in the hinge mounting plate of this invention.
Figure 5:
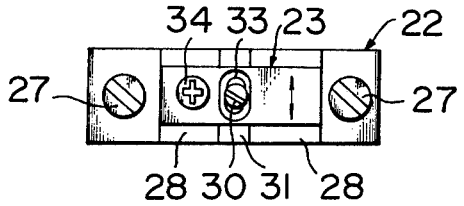
FIG. 5 is a plan view of the hinge mounting plate in which the control plate is superimposed on the surface of the base plate.
Figure 6:
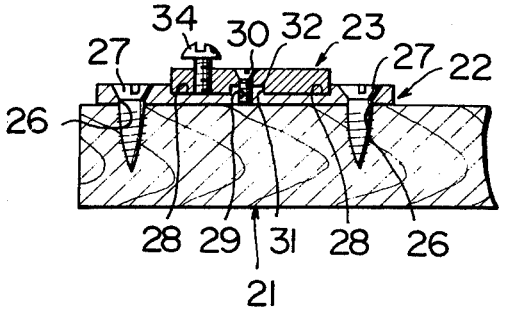
FIG. 6 is an elevational side sectional view of the base plate and the control plate in the hinge mounting plate of the invention.

The screw 44 can be passed through the hole 43 longitudinally to relatively approach or separate the second control plate 24 to or from the hinge supporting arm 25 around the pin 42 as a center as shown in FIG. 4.

A through hole 45 for inserting a tool is perforated at the top wall 39 of the hinge supporting arm 25 opposite to the holes 36 and 37.

The hinge mounting plate thus constructed can be assembled and longitudinally, laterally and elevationally adjusted as follows:

After the base plate 22 is secured by the wooden screws 27 to the supporting wall 21, the first control plate 23 is superimposed on the surface of the base plate 22 and engaged with the recess grooves 28 of the base plate 22, is adjusted longitudinally, and is then clamped by tightening the screw 30.

The first control plate 23 is then engaged with the recess 35 of the second control plate 24 to allow the second control plate 24 to be superimposed on the surfaces of the first control plate 23 and the base plate 22.

At this time the screw 34 is inserted through the hole 37 into the hole 36 to allow the second control plate 24 to be longitudinally adjusted with respect to the first control plate 23 accurately. Then, the screw 34 is fixedly fastened.

Figure 3:
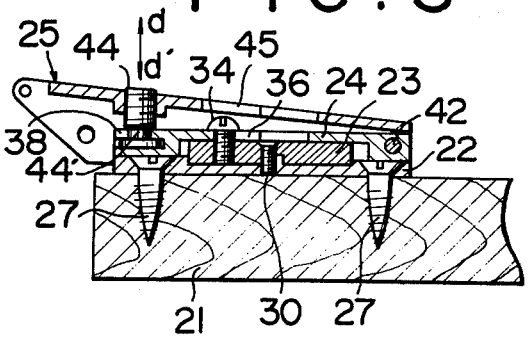
FIG. 3 is an elevational side sectional view of one preferred embodiment of the hinge mounting plate constructed according to the present invention.

Since the second control plate 24 is adjusted together with the hinge supporting arm 25 at this time to be pivotally secured at the rear side end, the hinge supporting arm 25 can be movable laterally around the pin 42 as a center, namely in the direction designated by arrows d—d' in FIG. 3 even after the second control plate 24 is secured.

When the screw 44 is then fastened, the screw 44 is engaged with the hole 38 at the neck 44' thereof to prevent axial movement and is mounted on the second control plate 24, the hinge supporting arm 25 is adjusted at the front side end with respect to the second control plate 24 in the direction of arrows d—d' as was described before.

When the screw 44 is accordingly controlled for lateral adjustment of the hinge mounting plate accurately, the latter can be secured to a desired position.

Thus, the elevational, longitudinal and lateral adjustments of the hinge mounting plate can be done solely by the screws 30, 34, and 44, in the respective directions.

Since the screw 30 can be put in place by inserting a tool through the hole 37 of the control plate 24 and the hole 45 of the hinge supporting arm 25, the hinge mounting plate can be adjusted longitudinally, laterally and elevationally even after assembled in the state as shown in FIG. 3.

It should be understood from the foregoing description that since the hinge mounting plate of this invention comprises the base plate 22, the second control plate 24 elevationally adjustably superimposed on the surface of the base plate 22, the lateral and longitudinal second control plate 24 pivotally integrally secured to the rear side end of the hinge supporting arm at the rear side end with the long hole 36 to be superimposed on the surface of the first control plate 23 to be clamped with the screw 34, and the screw 44 axially fixedly clamped to the second control plate 24 at the neck 44' thereof engaged with the hole 38 perforated longitudinally at the front side end of the control plate 24 to be fastened with the hinge supporting arm 25, the hinge mounting plate can be solely adjusted longitudinally, laterally and elevationally by the respective screws to eliminate the difficulties which occurred with the conventional ones for accurate adjustments in the three planes, and this can be done easily and rapidly by single operations.

It should also be appreciated that since the second control plate 24 is pivotally and integrally secured to the hinge supporting arm 26 at the rear end thereof, the hinge supporting arm 26 does not move even when the control screw 34 is loosened so as to be longitudinally adjusted.

What is claimed is:

1. A hinge mounting plate for securing a door to a supporting wall (21), said hinge mounting plate comprising in combination:

(a) an elongated flat rectangular base plate (22) which base plate is to be secured to a wall (21), said base plate having recess grooves (28);

(b) a hinge supporting arm (25) having an inverted U-shaped cross-section, which supporting arm (25) is to be pivotally secured to a door, said supporting arm (25) having side walls (40) and a rear pivoting end;

(c) a first control plate (23) of a width narrower than said base plate (22) with a lower surface disposed over the base plate with engaging means to engage said recess grooves (28) and with an upper surface;

(d) an elevational guide aperture (33) in said first control plate (23) with a mounting screw (30) fastened to the base plate (22) for holding the first control plate (23) thereto;

(e) a longitudinal and lateral second control plate (24), with front and rear ends having a lower recess (35) therein so sized that the second control plate (24) is disposed over the upper surface of the first control plate (23) so that the first control plate (23) is in said recess, a first aperture (36) passing through said recess with a first control screw (34) for fastening said second control plate (24) to said first control plate (23), and a second aperture (37) of larger diameter than said first aperture to insert the head of said first control screw (34) therethrough, a third aperture (38) at the front end of said second control plate (24) said third aperture (38) having an enlarged inner portion (38');

(f) a lateral control screw (44) passing through said third aperture (38), said lateral control screw (44) having a neck portion (44') engaged with said enlarged inner portion (38'); and, (g) pin pivot means (42) holding said supporting arm (25) to said second control plate (24) at the rear end of said supporting arm (25) and the rear end of said second control plate (24); whereby, the base plate (22) is first secured to a wall (21) by screws, the first control plate is placed over the base plate (22) and engaged with the recess grooves in said base plate, adjusted longitudinally and fastened by the mounting screw (30), the second control plate (24) is then placed over the first control plate (23) so that the first control plate (23) is in the lower recess (35), first control screw (34) in first aperture (36) is fixed after adjusting said second control plate (24), and, lateral control screw (44) in third aperture (38) is used to adjust said supporting arm (25).

* * * * *